United States Patent [19]

Fukano et al.

[11] 4,420,409

[45] Dec. 13, 1983

[54] HYDRAULIC SYSTEM AND HYDRAULIC FLUID COMPOSITIONS COMPRISING SILOXANE-OXYALKYLENE COPOLYMERS

[75] Inventors: Yoshimasa Fukano; Minoru Yoshizawa, both of Chiba, Japan

[73] Assignee: Toray Silicone Company, Ltd., Tokyo, Japan

[21] Appl. No.: 329,840

[22] Filed: Dec. 11, 1981

[51] Int. Cl.[3] ..... C10M 3/44

[52] U.S. Cl. ..... 252/78.3; 252/49.6; 556/453; 556/455; 556/456

[58] Field of Search ..... 252/78.3, 49.6; 556/453, 455, 456

[56] References Cited

U.S. PATENT DOCUMENTS

| | | | |
|---|---|---|---|
| 2,834,748 | 5/1958 | Bailey et al. | 252/78.3 |
| 3,234,252 | 2/1966 | Pater | 252/49.6 |
| 3,600,418 | 8/1971 | Bailey et al. | 252/78.3 |
| 3,833,505 | 9/1974 | Brown, Jr. | 252/78.3 |
| 4,324,720 | 3/1982 | Swihart | 252/49.6 |

*Primary Examiner*—John E. Kittle
*Assistant Examiner*—Hoa Van Le
*Attorney, Agent, or Firm*—George A. Grindahl

[57] ABSTRACT

Hydraulic fluid compositions are disclosed which have a high boiling point, a high compatibility with standard brake fluid and a high solubility of water. The disclosed hydraulic fluid compositions comprise from 1 to 100 percent by weight of selected siloxane-oxyalkylene copolymers and are suitable for use, for example, as automobile brake fluids.

10 Claims, No Drawings

HYDRAULIC SYSTEM AND HYDRAULIC FLUID COMPOSITIONS COMPRISING SILOXANE-OXYALKYLENE COPOLYMERS

BACKGROUND OF THE INVENTION

This invention concerns silicone copolymer fluids which are useful as hydraulic fluids, and particularly as automotive hydraulic fluids. More precisely, this invention concerns a hydraulic fluid which has a high boiling point and which contains, as a principal agent, a siloxane-oxyalkylene copolymer which is compatible with water and with glycols. One of the conventional hydraulic fluids is a composition containing glycol ether as a base fluid which is used in the brake and clutch systems in automobiles. One of the drawbacks of the hydraulic fluid containing glycol ether as a base fluid is that the glycol ether absorbs moisture from the atmosphere due to its moisture absorbing character, causing reduction in the boiling point of the hydraulic fluid and of the vapor lock temperature. Needless to say, it is a serious drawback for the hydraulic fluid to lose one of its important characteristics.

On the other hand, high-speed operation of automobiles, brought about by improvements in the performance of automobiles and the expansion and maintenance of road networks, has made it imperative to improve automobile hydraulic fluids. Moreover, the environment around the brake fluid has increased in temperature due to the installation of exhaust control systems in automobiles. Thus brake fluid with a high boiling point is in great demand. This property prevents the vapor lock phenomenon which occurs during high-speed driving and during frequent brake use on long downhill roads. The recent establishment of DOT 5 specification that the boiling point of a brake fluid be 260° C. or greater and the wet boiling point be 180° C. or greater (Federal Motor Vehicle Safety Standards and Regulations) was aimed at production of brake fluid with a high boiling point.

For this demand, the hydraulic fluid which contains glycol ether as a base is not satisactory; thus, various studies have been conducted and various hydraulic fluids have been disclosed. Although some of these satisfy the requirement of being high boiling point oils, they are not quite satisfactory when they are evaluated as hydraulic fluids. For example, there is a high boiling point hydraulic fluid using a special polyglycol ether as a starting oil. In this case, there is the drawback that the boiling point decreases easily when it absorbs moisture content from the atmosphere. In addition, a hydraulic fluid with low moisture absorbing character which contains a glycol ester as a base was also developed. However, this is more expensive than the hydraulic fluid which contains glycol ether as a base and is inferior, in terms of viscosity, to the hydraulic fluid which contains glycol ether as a base fluid.

Consequently, many silicone-type hydraulic fluids have recently been proposed. For example, the use of orthosilicate esters was disclosed in Kokai Japanese Patent No. SHo 49[1974]-95925. Since orthosilicates do not exhibit satisfactory stability to hydrolysis, they cannot be used as hydraulic fluids for automobiles. Moreover, the use of amino silicones was proposed in U.S. Pat. No. 3,725,287. However, these materials are relatively expensive and show relatively low wet boiling points, and thus the vapor lock phenomenon tends to occur in high moisture environments. In addition, silicone fluids which are useful as hydraulic fluids and which contain hydrocarbonoxy raicals have been disclosed in U.S. Pat. Nos. 2,834,748; 3,821,114; and 3,833,505. Silicone fluids containing ester-functional radicals have been disclosed in U.S. Pat. Nos. 3,830,744; 3,859,321; and 4,088,591. As with the orthosilicate esters noted above silicone fluids containing hydrocarbonoxy radicals or ester-functional radicals are also susceptible to hydrolysis to various degrees. Dimethyl silicone oil and phenylmethylsilicone oil are known as fluids with high boiling points and low moisture absorbing character. However, since these hydrocarbon silicone oils cause shrinkage of rubber parts of the hydraulic system which are in contact with the hydraulic fluid, the silicone oil may leak out. In addition, there is the drawback that the poor lubricating character of these silicone oils results in abrasion of the metal parts moving in the hydraulic system. For this reason, a silicone oil hydraulic fluid which is prepared by adding a rubber-expanding agent and a lubrication-improving agent to the silicone oils, was proposed in Japanese Patent No. Sho 53[1978]-10102.

The hydrocarbon silicone oil type hydraulic fluids have high boiling points, do not absorb moisture from the atmosphere, exhibit less chemical modification at high temperatures, and minimal viscosity changes with temperature. Thus, they are very promising hydraulic fluids. However, these hydraulic fluids of silicone oil have the following two problems. One of these problems is that when water enters the hydraulic system for some reason, such as when the hydraulic system is washed with water or the hydraulic system is exposed to rainfall, the boiling point is decreased a great deal since the silicone oil is not at all compatible with water, and there is high risk of occurrence of vapor lock phenomena. The other problem is that the hydraulic fluid is not compatible with glycols. That is, if a glycol hydraulic fluid is replaced with a hydrocarbon silicon oil hydraulic fluid in the hydraulic system, the hydraulic system may contain two types of fluids, i.e. glycol hydraulic fluid and silicon oil hydraulic fluid, which are incompatible, thereby requiring that the glycol hydraulic fluid be completely removed. Otherwise, the excellent characteristics of the silicone oil hydraulic fluid are dissipated and the characteristics obtained are the same as those of the glycol hydraulic fluid.

BRIEF SUMMARY OF THE INVENTION

It is an object of this invention to provide improved hydraulic fluid compositions. It is another object of this invention to provide hydraulic fluid compositions having the high boiling point performance of silicone hydraulic fluids. It is a further object of this invention to provide silicone hydraulic fluid compositions which are compatible with water and with glycol ether based hydraulic fluids. It is also an object of this invention to provide improved hydraulic systems comprising the hydraulic fluids of this invention.

These objects, and others which will become obvious to one upon consideration of the following specification and appended claims, are obtained by incorporating certain siloxane-oxyalkylene copolymers in a hydraulic fluid composition.

DETAILED DESCRIPTION OF THE INVENTION

The present invention relates to a hydraulic fluid composition comprising from 1 to 100 percent by weight, based on the weight of the hydraulic fluid composition, of at least one siloxane-oxyalkylene copolymer selected from the group consisting of $$R^1R^2R^3Si(OSiR^1R^2)_x(OSiR^1G)_yOSiR^1R^2R^3, \quad (I)$$

$$GR^1R^2Si(OSiR^1R^2)_x(OSiR^1G)_zOSiR^1R^2G, \quad (II)$$

$$R^1R^2R^3Si(OSiR^1R^2)_x(OSiR^1G)_zOSiR^1R^2G, \quad (III)$$

$$(OSiR^1R^2)_x(OSiR^1G)_y, \quad (IV)$$

$$R^1_aSi\{(OSiR^1R^2)_x(OSiR^1G)_yOSiR^1R^2R^3\}_{4-a} \quad (V) \text{ and}$$

$$R^1_aSi\{(OSiR^1R^2)_x(OSiR^1G)_zOSiR^1R^2G\}_{4-a} \quad (VI)$$

wherein each $R^1$ and $R^2$ denotes, independently, an alkyl radical, a halogen-substituted alkyl radical or a phenyl radical; each $R^3$ denotes, independently, an alkyl radical, a halogen-substituted alkyl radical, a phenyl radical, a hydroxyl radical or an alkoxy radical; each G denotes, independently, a radical having the formula—$D(OC_nH_{2n})_mR^4$ wherein D denotes a divalent hydrocarbon radical and $R^4$ denotes a hydroxyl radical or a monovalent organic radical; and each subscript denotes a number such that a=0 or 1, n=2 to 10 inclusive, m=1 to 500 inclusive, x=0 to 500 inclusive, y=1 to 500 inclusive and z=0 to 500 inclusive.

The hydraulic fluid compositions of this invention are characterized by containing from 1 to 100% by weight, based on the weight of the composition, of the siloxane-oxyalkylene copolymers delineated herein, and from 0 to 99% by weight of a fluid used in the art as a base fluid for hydraulic fluid compositions.

The siloxane-oxyalkylene copolymer component of the compositions of this invention, characterized by formulae I to VI, contains at least one silicon-bonded oxyalkylene radical and from 2 to 1000, preferably 2 to 500 silicon atoms, per molecule.

$R^1$ and $R^2$ radicals of the siloxane-oxyalkylene copolymer can be identical or different, as desired, and are selected from the group consisting of alkyl radicals having from 1 to 10 carbon atoms, such as methyl, ethyl, propyl, butyl, octyl and decyl; halogenated alkyl radicals, such as 3,3,3-trifluoropropyl; and phenyl. $R^1$ and $R^2$ are preferably methyl. $R^3$ radicals can be any $R^1$ or $R^2$ radical denoted above or a hydroxyl radical or an alkoxy radical, such as $OCH_3$, $OCH_2CH_3$, $OCH(CH_3)_2$ or $OC_4H_9$. For maximum hydrolylic stability $R^3$ is preferably selected from $R^1$ and $R^2$ radicals.

The oxyalkylene radicals, denoted as G, have the formula —$D(OC_nH_{2n})_mR^4$. The subscript n can have a value of from 2 to 10, inclusive, thereby providing for oxyalkylene segments having the formulae —$OCH_2CH_2$—, —$OCH_2CH_2CH_2$—, $$-OCH_2\overset{|}{C}H(CH_3), \quad -OCH_2CH_2CH_2CH_2-,$$

-continued $$-OCH_2CH_2\overset{|}{C}H(CH_3), \quad -OCH_2\overset{|}{C}H(CH_3)CH_2-,$$

etc. The subscript m can have a value of from 1 to 500. When m has a value greater than 1, the multiple oxyalkylene segments may be the same or different, as desired. Preferred oxyalkylene segments are the well-known oxyethylene segments and oxypropylene segments.

The oxyalkylene radicals, G, are terminated by an $R^4$ radical which can be a hydroxyl radical or an organic radical, such as alkoxy radicals having from 1 to 10 carbon atoms, such as $OCH_3$, $OCH_2CH_3$, $OCH_2CH_2CH_3$ and $OCH_2CH_2CH_2CH_3$; acyloxy radicals, such as acetoxy or propionoxy, aryloxy radicals, such as $OC_6H_5$; and other radicals, such as $OCH_2CH_2CN$. The selection of the $R^4$ radical is not critical for the purposes of this invention.

Each oxyalkylene radical, G, is bonded to a silicon atom of the siloxane-oxyalkylene copolymer by a divalent hydrocarbon radical, D. Examples of D radicals include alkylene radicals having from 1 to 10 carbon atoms, such as —$CH_2$—, —$CH_2CH_2$—, —$CH_2CH_2CH_2$—, $$-CH_2\overset{|}{C}HCH_3,$$

$$-CH_2CH_2CH_2CH_2-,$$

$$-CH_2CH_2\overset{|}{C}HCH_3,$$

and —$CH_2CH_2CH_2CHCH_3$.

A highly preferred G radical has the formula $$-D(OCH_2CH_2)_b(OCH_2\overset{CH_3}{\overset{|}{C}}H)_cR^4$$

wherein b has a value of from 0 to 100, c has a value of from 0 to 100 and the sum of b+c has a value of from 1 to 200. As noted above, the type of $R^4$ radical is not critical but it is typically hydroxy, methoxy, butoxy or acetoxy in these highly preferred G radicals.

Highly preferred siloxane-oxyalkylene copolymers for use in the hydraulic fluid compositions of this invention are exemplified by the examples, hereinafter disclosed, and have the following formulae, wherein Me denotes the methyl radical;

$$Me_3Si(OSiMe_2)_x(OSiMeG)_ySiMe_3,$$

$$GMe_2Si(OSiMe_2)_xOSiMe_2G \text{ and}$$

$$MeSi\{(OSiMe_2)_xOSiMe_2G\}_3,$$

wherein G denotes $$-D(OCH_2CH_2)_b(OCH_2\overset{CH_3}{\overset{|}{C}}H)_cR^4.$$

In these highly preferred copolymers D is preferably an alkylene radical.

The siloxane-oxyalkylene copolymers used in this invention include those having a viscosity sufficiently low to allow their use as the sole component of the hydraulic fluid compositions of this invention. Siloxane-oxyalkylene copolymers delineated above which have higher viscosities may also be used in the hydraulic fluid compositions of this invention when they are mixed with lower viscosity materials such as polydimethylsiloxane oils, polyphenylmethylsiloxane oils and glycols. Of course, the lower viscosity siloxane-oxyalkylene copolymers may also be mixed with said lower viscosity materials, if desired.

This invention further includes the use of a mixture of other hydraulic fluids with 1 wt % or greater of the siloxane-oxyalkylene copolymer, rather than the sole use of siloxane-oxyalkylene copolymers directly as a hydraulic fluid. Other suitable hydraulic fluids include the well-known oxyalkylene polymer oils which are compatible with siloxane-oxyalkylene copolymers, such as polyethylene glycol, polypropylene glycol, polyethylenepropylene glycol and their various partially or fully capped analogs, such as methyl ether capped analogs, ethyl ether capped analogs and butyl ether capped analogs.

Thus, it is within the scope of this invention to prepare a hydraulic fluid composition comprising from 1 to 99% by weight of the above-delineated siloxane-oxyalkylene copolymer and from 1 to 99% by weight of said oxyalkylene polymer oil which is compatible with said siloxane-oxyalkylene copolymer.

Moreover, if desirable, conventional hydraulic fluids or a variety of additives which are ordinarily added to the hydraulic fluids can be added to the hydraulic fluid of this invention which contain siloxane-oxyalkylene copolymers as a principal component. Examples of these additives are as follows: antioxidants such as 2,6-di-tert-butyl p-cresol, p-tert-butylcresol and $\beta$-naphthylamine; rust-proofing agents such as benzotriazole; agents to improve the oil character such as tricresyl phosphate, glycols, oils and fats; and silicone oils of dimethyl series or phenylmethyl series. These additives can be added in arbitrary amounts as long as the purpose of this invention is not impaired.

The present invention further relates to an improved hydraulic system comprising hydraulic activating means, hydraulic activated means, hydraulic line means connecting said activating means and said activated means and a hydraulically effective amount of a hydraulic fluid, the improvement comprising using, as said hydraulic fluid, a hydraulic fluid composition comprising from 1 to 100 percent by weight, based on the weight of the hydraulic fluid composition, of at lease one siloxane-oxyalkylene copolymer selected from the group consisting of $$R^1R^2R^3Si(OSiR^1R^2)_x(OSiR^1G)_yOSiR^1R^2R^3, \quad (I)$$

$$GR^1R^2Si(OSiR^1R^2)_x(OSiR^1G)_zOSiR^1R^2G, \quad (II)$$

$$R^1R^2R^3Si(OSiR^1R^2)_x(OSiR^1G)_zOSiR^1R^2G, \quad (III)$$

$$\overline{(OSiR^1R^2)_x(OSiR^1G)_y}, \quad (IV)$$

$$R^1_aSi\{(OSiR^1R^2)_x(OSiR^1G)_yOSiR^1R^2G\}_{4-a} \text{ and} \quad (V)$$

$$R^1_aSi\{(OSiR^1R^2)_x(OSiR^1G)_zOSiR^1R^2G\}_{4-a} \quad (VI)$$

wherein each $R^1$ and $R^2$ denotes, independently, an alkyl radical, a halogen-substituted alkyl radical or a phenyl radical; each $R^3$ denotes, independently, an alkyl radical, a halogen-substituted alkyl radical, a phenyl radical, a hydroxyl radical or an alkoxy radical; each G denotes, independently, a radical having the formula $-D(OC_nH_{2n})_mR^4$ wherein D denotes a divalent hydrocarbon radical and $R^4$ denotes a hydroxyl radical or a monovalent organic radical; and each subscript denotes a number such that a=0 or 1, n=2 to 10 inclusive, m=1 to 500 inclusive, x=0 to 500 inclusive, y=1 to 500 inclusive and z=0 to 500 inclusive.

The improved hydraulic system of this invention has as its novel feature a hydraulically effective amount of the hydraulic fluid compositions of this invention. These hydraulic fluid compositions have been fully delineated above.

In all other features the improved hydraulic systems of this invention are conventional and further comprise conventional hydraulic activating means, conventional hydraulic activated means and conventional hydraulic line means which connect said activating and said activated means to permit fluid contact between said activating and said activated means.

Being thus conventional in all features, except the hydraulic fluid contained therein, the improved hydraulic systems of this invention need no further delineation beyond the above disclosed full delineation of said hydraulic fluid.

In a preferred embodiment of this invention the improved hydraulic system comprising the novel hydraulic fluid of this invention is an automotive hydraulic brake system comprising, as the activating means, the necessary piston-containing cylinder(s) and necessary connecting means to permit an operator of the brake system to apply a braking force to the system; as the activated means, the necessary piston-containing cylinder(s) and necessary connecting means to transfer the braking force to brake shoe(s) and brake drum(s) and/or brake disc(s) and brake rotor(s), and; as hydraulic line means, the necessary rigid and/or flexible tubes to permit fluid communication between said activating means and said activated means. The automotive brake system can further comprise conventional components such as a fluid reservoir, valves, and engine-operated pressure-generating means.

The improved hydraulic system of this invention contains a sufficient amount, typically an amount sufficient to substantially fill the hydraulic system, of the novel hydraulic fluid composition of this invention to effectively transfer operator force, applied to the activating means to the activated means as a braking force.

The following examples are disclosed to further illustrate, but not to limit, the present invention. All parts and percentages are parts by weight. The symbol Me denotes the methyl radical.

EXAMPLE 1

A siloxane with the average chemical formula $Me_3SiO(Me_2SiO)_6(MeHSiO)_4SiMe_3$ (30 parts), a polyoxyalkylene glycol with the average chemical formula $CH_2{=}CH{-}CH_2{-}(OC_2H_4)_{10}OH$ (70 parts), toluene (100 parts), and chloroplatinate ($H_2PtCl_6.6H_2O$) (10 ppm) were placed in a flask equipped with a stirring device, a thermometer and a reflux condenser, and the mixture was refluxed for 4 hours. After removing toluene and the volatile contents by evaporation under reduced pressure at high temperature (5 mm Hg, 170° C.), a siloxane-polyoxyalkylene copolymer with the average chemical formula (A) was obtained.

$$\begin{array}{l} (CH_2)_3\text{-}(OC_2H_4)_{10}\text{-}OH \\ | \\ Me_3SiO(Me_2SiO)_6(MeSiO)_4SiMe_3 \end{array} \quad (A)$$

The kinematic viscosity of this siloxane-polyoxyalkylene copolymer at 25° C. (cS), solubility of water at 25° C. (wt %), compatibility with standard brake fluid using glycol ether as a base, as specified in JIS-K-2233 (automobile brake fluid), at 25° C., and the boiling point as specified in JIS-K-2233 were determined. The results are presented in Table I. The copolymer obtained was found to be suitable as a brake fluid.

EXAMPLE 2

A siloxane with the chemical formula $HMe_2SiO(Me_2SiO)_{12}SiMe_2H$ (45 parts), a polyoxyalkylene glycol with the average chemical formula $CH_2{=}CH{-}CH_2{-}(OC_2H_4)_{10}OH$ (55 parts), toluene (100 parts), chloroplatinate ($H_2PtCl_6.6H_2O$) (10 ppm) were placed in a flask equipped with a stirring device, a thermometer and a reflux condenser, and the mixture was refluxed for 4 hours. After removing toluene and volatile contents by evaporation under reduced pressure at high temperature (5 mm Hg, 170° C.), a siloxane-polyoxyalkylene copolymer with the average chemical formula (B) was obtained. $HO{-}(H_4C_2O)_{10}H_6C_3(Me)_2SiO(Me_2SiO)_{12}Si(Me)_2{-}C_3H_6{-}(OC_2H_4)_{10}OH$ (B) As in Example 1, the kinematic viscosity, solubility of water, compatibility with the standard glycol ether-based brake fluid, and boiling point were determined. The results are presented in Table I.

TABLE I

| Siloxane-Oxyalkylene Copolymer Formula | Kinematic Viscosity, cS. | Solubility of $H_2O$, wt % | Compatibility With Standard Brake Fluid, wt % | Boiling Point, °C. |
|---|---|---|---|---|
| (A) | 352 | ∞ | ∞ | 285 |
| (B) | 343 | 4 | ∞ | 290 |
| (C) | 39 | 3 | ∞ | ≧300 |
| (D) | 37 | 3 | ∞ | ≧300 |
| (E)* | 1425 | ∞ | ∞ | ≧300 |
| (F) | 1120 | ∞ | ∞ | ≧300 |
| (A)** | 328 | ∞ | ∞ | ≧300 |

*Mixed with $CH_2{=}CHCH_2(OC_3H_6)_{22}(OC_2H_4)_{22}OCOCH_3$.
**Mixed with 90% $C_4H_9O(C_2H_4O)_{18}(C_3H_6O)_{18}H$.

EXAMPLE 3

A siloxane with the average chemical formula $HMe_2SiO(Me_2SiO)_5SiMe_2H$ (45 parts), a polyoxyalkylene glycol with the average chemical formula $CH_2{=}CH{-}CH_2{-}(OC_3H_6)_2OH$ (55 parts), toluene (100 parts), chloroplatinate ($H_2PtCl_6.6H_2O$) (10 ppm) were placed in a flask equipped with a stirring device, a thermometer and a reflux condenser, and the mixture was refluxed for 4 hours. After removing toluene, the unreacted polyoxyalkylene glycol, and volatile contents by evaporation under reduced pressure at high temperature (5 mm Hg, 170° C.), a siloxane-polyoxyalkylene copolymer with the average chemical formula (C) was obtained.

$$HO(H_6C_3O)_2H_6C_3(Me_2SiO)_6Si(Me)_2C_3H_6(OC_3H_6)_2OH \quad (C)$$

As in Example 1, the kinematic viscosity, solubility of water, compatibility with the standard glycol ether-based brake fluid and boiling point were determined. The results are presented in Table I.

EXAMPLE 4

A siloxane with the average chemical formula $Me_3SiO(Me_2SiO)_3(MeHSiO)_2SiMe_3$ (45 parts), a polyoxyalkylene glycol with the average chemical formula $CH_2{=}CH{=}CH_2{-}(OC_3H_6)_3OH$ (55 parts), toluene (100 parts) and chloroplatinate ($H_2PtCl_6.6H_2O$) (10 ppm) were placed in a flask equipped with a stirring device, a thermometer and a reflux condenser, and the mixture was refluxed for 4 hours. After removing toluene, unreacted glycol and low molecular weight materials by evaporation under reduced pressure at high temperature (5 mm Hg, 170° C.), a siloxane-polyoxyalkylene copolymer with the average chemical formula (D) was obtained.

$$\begin{array}{l} C_3H_6\text{-}(OC_3H_6)_3OH \\ | \\ Me_3SiO(Me_2SiO)_3(MeSiO)_2SiMe_3 \end{array} \quad (D)$$

As in Example 1, the kinematic viscosity, solubility of water, compatibility with the standard glycol ether-based brake fluid, and boiling point were determined. The results are presented in Table I.

EXAMPLE 5

A siloxane with the average chemical formula $Me_3SiO(Me_2SiO)_{90}(MeHSiO)_{10}SiMe_3$ (15 parts), a polyoxyalkylene glycol with the average chemical formula $CH_2{=}CHCH_2{-}(OC_3H_6)_{22}(OC_2H_4)_{22}OCOCH_3$ (85 parts), toluene (100 parts) and chloroplatinate ($H_2PtCl_6.6H_2O$) (10 ppm) were placed in a flask equipped with a stirring device, a thermometer, and a reflux condenser, and the mixture was refluxed for 4 hours. After removing toluene and volatile materials by evaporation under reduced pressure at high temperature (5 mm Hg, 170° C.), a liquid mixture of a siloxane-polyoxyalkylene copolymer with the average chemical formula (E) and the unreacted polyoxyalkylene glycol was obtained.

$$\begin{array}{l} Me_3SiO(Me_2SiO)_{90}(MeSiO)_{10}SiMe_3 \\ \qquad\qquad\qquad\qquad | \\ \qquad\qquad\qquad (CH_2)_3\text{-}(OC_3H_6)_{22}(OC_2H_4)_{22}\text{-}OCOCH_3 \end{array} \quad (E)$$

As in Example 1, the kinematic viscosity of the mixture, solubility of water, compatibility with the standard glycol ether-based brake fluid, and boiling point were determined. The results are presented in Table I.

EXAMPLE 6

A siloxane with the average chemical formula $MeSi\{O(Me_2SiO)_7SiMe_2H\}_3$ (23 parts), a polyoxyalkylene glycol (77 parts) with the average chemical formula $$CH_2{=}\overset{\overset{CH_3}{|}}{C}{-}CH_2{-}(OC_2H_4)_{20}(OC_3H_6)_{20}{-}OC_4H_9$$

toluene (100 parts) and chloroplatinate ($H_2PtCl_6.6H_2O$) (10 ppm) were placed in a flask equipped with a stirring device, a thermometer and a reflux condenser, and the mixture was refluxed for 4 hours. After removing toluene and volatile materials by evaporation under reduced pressure at high temperature (5 mm Hg, 170° C.), a siloxane-polyoxyalkylene copolymer with the average chemical formula (F) was obtained.

$$MeSi\{O(Me_2SiO)_7SiMe_2CH_2CH(CH_3)CH_2—(OC_2H_4)_{20}(OC_3H_6)_{20}OC_4H_9\}_3 \quad (F)$$

As in Example 1, the kinematic viscosity, solubility of water, compatibility with the standard glycol-ether based brake fluid, and boiling point were determined. The results are presented in Table I.

EXAMPLE 7

The siloxane-polyoxyalkylene copolymer (A) obtained in Example 1 (10 parts) and a polyoxyalkylene monoalkyl ether with the average chemical formula $C_4H_9—O—(C_2H_4O)_{18}—(C_3H_6O)_{18}—H$ (90 parts) were mixed. The viscosity of the mixture, solubility of water, compatibility with the standard brake fluid specified in JIS-K-2233, and boiling point specified in JIS-K-2233 were determined. The results are presented in Table I.

EXAMPLE 8

Phenyl β-naphthylamine (0.2 wt %) was added as an antioxidant to the siloxane-polyoxyalkylene copolymers (C) and (D), obtained in Examples 3 and 4 respectively, to obtain composition 1 and composition 2, respectively. With respect to compositions 1 and 2, the metal corroding ability and the rubber swelling ability were evaluated according to JIS-K-2233 (brake fluid for automobile). The results are presented in Tables II and III. Both compositions exhibited minimal metal corroding ability and rubber swelling ability, and were evaluated to be suitable as brake fluids.

TABLE II

| Metal corroding ability (100 ± 2° C.) 120 ± 2 h | | | Composition 1 | Composition 2 |
|---|---|---|---|---|
| Metal test specimen | Change in mass, mg/cm² | Tin plate | −0.003 | −0.002 |
| | | Steel | −0.001 | −0.001 |
| | | Aluminum | −0.002 | −0.007 |
| | | Cast iron | ±0.0 | −0.001 |
| | | Brass | −0.004 | −0.005 |
| | | Copper | −0.008 | −0.007 |
| | Appearance | | No abnormalities | No abnormalities |
| Characteristics of the liquid | Appearance | | No abnormalities | No abnormalities |
| | pH | | 8.0 | 8.0 |
| | Volume precipitated, V/V % | | 0.05 | 0.03 |
| Condition of rubber cup | Change in the base diameter, mm | | 0.18 | 0.10 |
| | Change in hardness, Hs | | −9 | −8 |
| | Appearance | | No abnormalities | No abnormalities |

TABLE III

| Conditions | Rubber swelling ability, SBR cup | Composition 1 | Composition 2 |
|---|---|---|---|
| 70 ± 2° C. | Increase in the base diameter, mm | +0.45 | +0.28 |
| 70 ± 2 hr. | Change in hardness, Hs | −7 | −4 |
| | Appearance | No abnormalities | No abnormalities |
| 120 ± 2° C. | Increase in the base diameter, mm | +0.673 | +0.40 |
| 70 ± 2 hr. | Change in hardness, Hs | −11 | −9 |
| | Appearance | No abnormalities | No abnormalities |

That which is claimed is:

1. A hydraulic fluid composition consisting essentially of 1 to 99 percent by weight, based on the weight of the hydraulic fluid composition, of at least one siloxane-oxyalkylene copolymer and 1 to 99 percent by weight, based on the weight of the hydraulic fluid composition, of an oxyalkylene polymer oil which is compatible with the siloxane-oxyalkylene copolymer, said siloxane-oxyalkylene copolymer being selected from the group consisting of $$R^1R^2R^3Si(OSiR^1R^2)_x(OSiR^1G)_yOSiR^1R^2R^3, \quad (I)$$

$$GR^1R^2Si(OSiR^1R^2)_x(OSiR^1G)_zOSiR^1R^2G, \quad (II)$$

$$R^1R^2R^3Si(OSiR^1R^2)_x(OSiR^1G)_zOSiR^1R^2G, \quad (III)$$

$$(OSiR^1R^2)_x(OSiR^1G)_y, \quad (IV)$$

$$R_a^1Si\{(OSiR^1R^2)_x(OSiR^1G)_yOSiR^1R^2R^3\}_{4-a} \text{ and} \quad (V)$$

$$R_a^1Si\{(OSiR^1R^2)_x(OSiR^1G)_zOSiR^1R^2G\}_{4-a} \quad (VI)$$

wherein each $R^1$ and $R^2$ denotes, independently, an alkyl radical, a halogen-substituted alkyl radical or a phenyl radical; each $R^3$ denotes, independently, an alkyl radical, a halogen-substituted alkyl radical, a phenyl radical, a hydroxyl radicals or an alkoxy radical; each G denotes, independently, a radical having the formula $—D(OC_nH_{2n})_mR^4$ wherein D denotes a divalent hydrocarbon radical and $R^4$ denotes a hydroxyl radical or a monovalent organic radical; and each subscript denotes a number such that a=0 or 1, n=2 to 10 inclusive, m=1 to 500 inclusive, x=0 to 500 inclusive, y=1 to 500 inclusive and z=0 to 500 inclusive.

2. A hydraulic fluid composition according to claim 1 wherein each G denotes a radical having the formula $$—D(OCH_2CH_2)_b(OCH_2\overset{CH_3}{\overset{|}{C}}H)_cR^4$$

wherein b has a value of from 0 to 100, c has a value of from 0 to 100 and the sum b+c has a value of from 1 to 200.

3. A hydraulic fluid composition according to claim 2 wherein the siloxane-oxyalkylene copolymer is $Me_3Si(OSiMe_2)_x(OSiMeG)_ySiMe_3$, wherein Me denotes the methyl radical.

4. A hydraulic fluid composition according to claim 2 wherein the siloxane-oxyalkylene copolymer is $GMe_2Si(OSiMe_2)_xOSiMe_2G$, wherein Me denotes the methyl radical.

5. A hydraulic fluid composition according to claim 2 wherein the siloxane-oxyalkylene copolymer is $MeSi\{(OSiMe_2)_xOSiMe_2G\}_3$, wherein Me denotes the methyl radical.

6. In a hydraulic system comprising hydraulic activating means, hydraulic activated means, hydraulic line means connecting said activating means and said activated means and a hydraulically effective amount of a hydraulic fluid, the improvement comprising using, as said hydraulic fluid, a hydraulic fluid composition consisting essentially of 1 to 99 percent by weight, based on the weight of the hydraulic fluid composition, of at least one siloxane-oxyalkylene copolymer and 1 to 99 percent by weight, based on the weight of the hydraulic fluid composition, of an oxyalkylene polymer oil which is compatible with the siloxane-oxyalkylene copolymer, said siloxane-oxyalkylene copolymer being selected from the group consisting of $$R^1R^2R^3Si(OSiR^1R^2)_x(OSiR^1G)_yOSiR^1R^2R^3, \quad (I)$$

$$GR^1R^2Si(OSiR^1R^2)_x(OSiR^1G)_zOSiR^1R^2G, \quad (II)$$

$$R^1R^2R^3Si(OSiR^1R^2)_x(OSiR^1G)_zOSiR^1R^2G, \quad (III)$$

$$\overline{(OSiR^1R^2)_x(OSiR^1G)_y}, \quad (IV)$$

$$R_a^1Si\{(OSiR^1R^2)_x(OSiR^1G)_yOSiR^1R^2R^3\}_{4-a} \text{ and} \quad (V)$$

$$R_a^1Si\{(OSiR^1R^2)_x(OSiR^1G)_zOSiR^1R^2G\}_{4-a} \quad (VI)$$

wherein each $R^1$ and $R^2$ denotes, independently, an alkyl radical, a halogen-substituted alkyl radical or a phenyl radical; each $R^3$ denotes, independently, an alkyl radical, a halogen-substituted alkyl radical, a phenyl radical, a hydroxyl radical or an alkoxy radical; each G denotes, independently, a radical having the formula $-D(OC_nH_{2n})_mR^4$ wherein D denotes a divalent hydrocarbon radical and $R^4$ denotes a hydroxyl radical or a monovalent organic radical; and each subscript denotes a number such that a=0 or 1, n=2 to 10 inclusive, m=1 to 500 inclusive, x=0 to 500 inclusive, y=1 to 500 inclusive and z=0 to 500 inclusive.

7. A hydraulic system according to claim 6 wherein, in the hydraulic fluid each G denotes a radical having the formula $$-D(OCH_2CH_2)_b(OCH_2\overset{\overset{CH_3}{|}}{C}H)_cR^4$$

wherein b has a value of from 0 to 100, c has a value of from 0 to 100 and the sum c+b has a value of from 1 to 200.

8. A hydraulic system according to claim 7 wherein the siloxane-oxyalkylene copolymer in the hydraulic fluid is $Me_3Si(OSiMe_2)_x(OSiMeG)_ySiMe_3$, wherein Me denotes the methyl radical.

9. A hydraulic fluid composition according to claim 7 wherein the siloxane-oxyalkylene copolymer in the hydraulic fluid is $GMe_2Si(OSiMe_2)_xOSiMe_2G$, wherein Me denotes the methyl radical.

10. A hydraulic fluid composition according to claim 7 wherein the siloxane-oxyalkylene copolymer in the hydraulic fluid is $MeSi\{(OSiMe_2)_xOSiMe_2G\}_3$, wherein Me denotes the methyl radical.

* * * * *

UNITED STATES PATENT AND TRADEMARK OFFICE

CERTIFICATE OF CORRECTION

PATENT NO. : 4,420,409

DATED : December 13, 1983

INVENTOR(S) : Yoshimasa Fukano, Minoru Yoshizawa

It is certified that error appears in the above-identified patent and that said Letters Patent is hereby corrected as shown below:

In column 11, line 24, "$^{1}R^{2}R^{3}Si$" should read -- $R^{1}R^{2}R^{3}Si$ --.

Signed and Sealed this

*Eighth* Day of *January 1985*

[SEAL]

*Attest:*

*Attesting Officer*

GERALD J. MOSSINGHOFF

*Commissioner of Patents and Trademarks*